US009254067B2

(12) United States Patent
Yaari et al.

(10) Patent No.: US 9,254,067 B2
(45) Date of Patent: Feb. 9, 2016

(54) INFANT FEEDING AND BATHING SYSTEM

(71) Applicants: Galia Yaari, Aventura, FL (US); Michal Yaari, Aventura, FL (US)

(72) Inventors: Galia Yaari, Aventura, FL (US); Michal Yaari, Aventura, FL (US)

( * ) Notice: Subject to any disclaimer, the term of this patent is extended or adjusted under 35 U.S.C. 154(b) by 288 days.

(21) Appl. No.: 13/803,684

(22) Filed: Mar. 14, 2013

(65) Prior Publication Data

US 2014/0259359 A1 Sep. 18, 2014

(51) Int. Cl.

| | |
|---|---|
| ***A47K 3/064*** | (2006.01) |
| ***A47K 3/12*** | (2006.01) |
| ***A47D 1/10*** | (2006.01) |
| ***A47D 9/00*** | (2006.01) |
| ***A47D 11/00*** | (2006.01) |
| ***A47D 15/00*** | (2006.01) |

(52) U.S. Cl.

CPC ..... *A47K 3/064* (2013.01); *A47D 1/103* (2013.01); *A47D 9/00* (2013.01); *A47D 11/00* (2013.01); *A47D 15/00* (2013.01); *A47K 3/127* (2013.01)

(58) Field of Classification Search

CPC ..... A47K 3/127
USPC ..... 4/538–595; 607/81; D24/204; D23/277–278

See application file for complete search history.

(56) References Cited

U.S. PATENT DOCUMENTS

| | | | | | |
|---|---|---|---|---|---|
| 3,143,746 | A * | 8/1964 | Spear | 5/94 |
| D237,288 | S * | 10/1975 | Crawford | D21/467 |
| 4,670,923 | A * | 6/1987 | Gabriel et al. | 5/424 |
| 4,725,253 | A * | 2/1988 | Politte | 441/130 |
| 5,005,902 | A * | 4/1991 | Farnworth et al. | 297/250.1 |
| 5,033,742 | A * | 7/1991 | Johnson et al. | 482/140 |
| 5,292,175 | A * | 3/1994 | Artz | 297/250.1 |
| 5,330,255 | A * | 7/1994 | Stawicki | 297/391 |
| 5,546,620 | A * | 8/1996 | Matthews | 5/655 |
| 5,993,276 | A * | 11/1999 | Ponton et al. | 441/130 |
| 6,354,665 | B1 * | 3/2002 | Ross | 297/452.41 |
| 7,160,235 | B2 * | 1/2007 | McNally et al. | 482/142 |
| D562,577 | S * | 2/2008 | Dengler et al. | D6/358 |
| 8,047,375 | B1 * | 11/2011 | Hartsfield | 206/581 |
| 2002/0100116 | A1 * | 8/2002 | Richards | 5/108 |
| 2002/0108181 | A1 * | 8/2002 | Matthews Brown et al. | 5/655.3 |
| 2003/0220032 | A1 * | 11/2003 | Hsu et al. | 441/131 |
| 2004/0033873 | A1 * | 2/2004 | Van Straaten | 482/142 |
| 2004/0075318 | A1 * | 4/2004 | Wroobel | 297/256.17 |
| 2004/0130194 | A1 * | 7/2004 | Wroobel | 297/256.17 |
| 2006/0014613 | A1 * | 1/2006 | Van Straaten et al. | 482/140 |
| 2007/0056110 | A1 * | 3/2007 | Tuoriniemi et al. | 5/655 |
| 2007/0271703 | A1 * | 11/2007 | Matthews Brown et al. | 5/636 |
| 2008/0100109 | A1 * | 5/2008 | Frank | 297/238 |
| 2013/0015690 | A1 * | 1/2013 | Mendis et al. | 297/250.1 |
| 2013/0076081 | A1 * | 3/2013 | Curto | 297/148 |

OTHER PUBLICATIONS www.bloomingbath.com—Bolooming Bath Baby Bath, Baby Set, Baby Tub, p. 19—Jun. 2, 2013.

* cited by examiner

*Primary Examiner* — Lori Baker
(74) *Attorney, Agent, or Firm* — Fleit Gibbons Gutman Bongini & Bianco PL; Gary S. Winer; Paul D. Bianco

(57) ABSTRACT

An infant support has an inflatable seat back portion forming a back support and a portion of a bottom side, a bottom support portion extending below the seat back portion in a direction of a longitudinal end of the infant support device, the bottom support portion forming at least a portion of a bottom side of the infant support. Additionally, an inflatable side portion extends from the seat back portion along transverse sides of the infant support. Together, the inflatable portions form an infant tub when inflated. The bottom support and side portion can be partially or fully deflated, and will thereby dangle or depend from the seat back portion, the infant support thereby forming a chair. A number of inflatable infant care items are combined with the inflatable infant support to form an infant care travel kit.

21 Claims, 4 Drawing Sheets

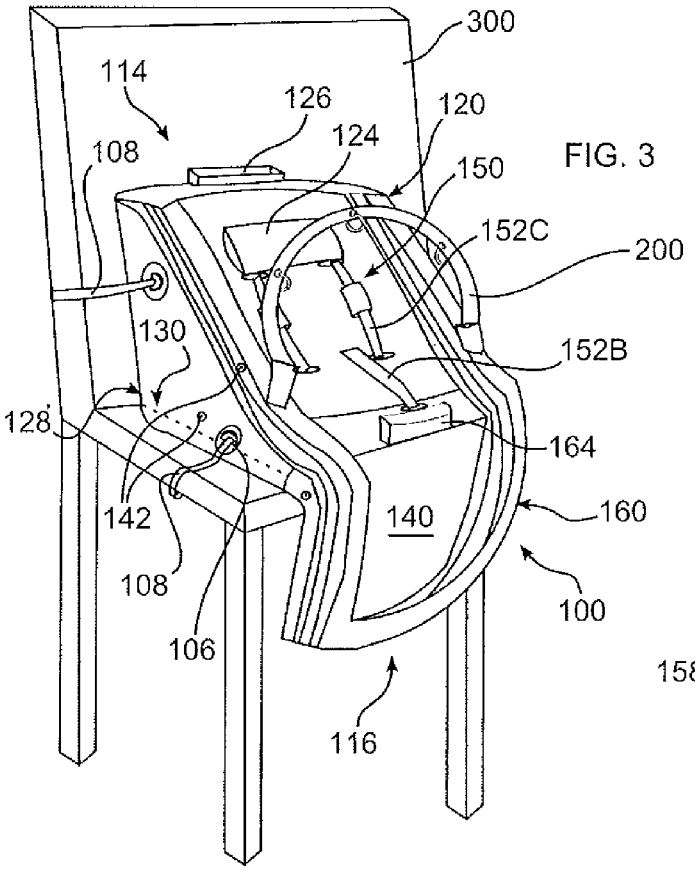
FIG. 3
FIG. 4
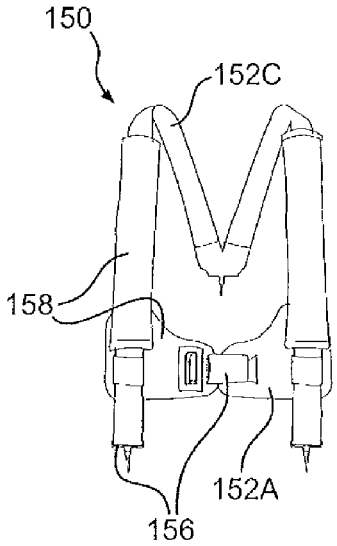
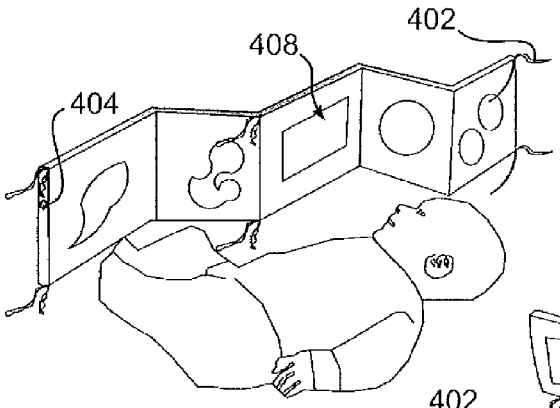
FIG. 5
FIG. 6
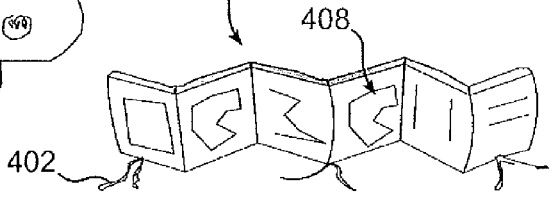

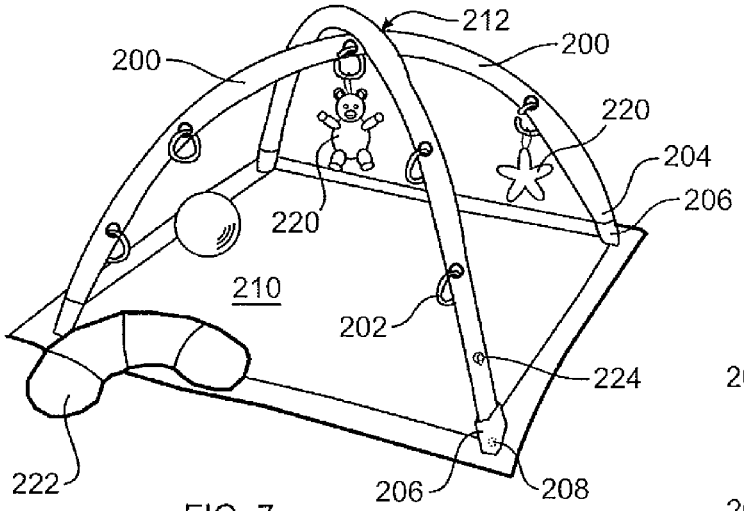
FIG. 7
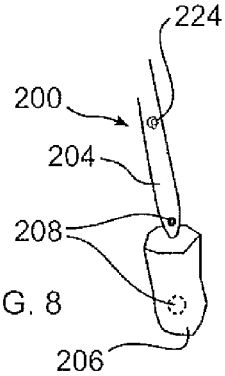
FIG. 8
FIG. 8A
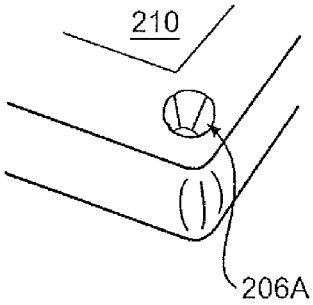
FIG. 9
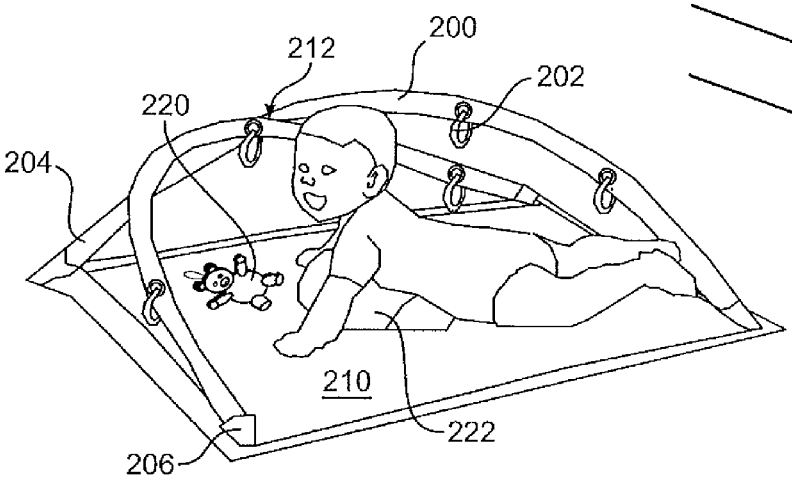

INFANT FEEDING AND BATHING SYSTEM

FIELD OF THE INVENTION

This invention relates to portable items for the care of infants, and more particularly to inflatable furnishings for washing, feeding, and protecting infants.

BACKGROUND OF THE INVENTION

An inflatable crib bumper, which may be integrated with an inflatable mattress, is disclosed in U.S. Pat. No. 4,670,923.

An inflatable baby seat is disclosed in U.S. Pat. No. 5,005,902.

A mat with an inflatable cushion, upon which a baby may lie, is disclosed in U.S. Pat. No. 5,546,620.

A diaper changing kit is disclose in U.S. Pat. No. 8,047,375.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

SUMMARY OF THE INVENTION

In an embodiment of the disclosure, an infant support, comprises an inflatable seat back portion proximate a first longitudinal end of the infant support device and forming a back support and a portion of a bottom side of the infant support; a bottom support portion extending below the seat back portion in a direction of a second longitudinal end of the infant support device opposite the first longitudinal end, the bottom support portion forming at least a portion of a bottom side of the infant support; and an inflatable side portion extending from the seat back portion along a first transverse side, then along the second longitudinal end, then along a second transverse side, the infant support forming an infant tub when the seat back and side portions are inflated, the infant support forming a chair when the seat back portion is inflated and the side portion is deflated, wherein the side portion is collapsible in a direction of the bottom support when the seat back portion is inflated.

In various embodiments thereof, the bottom support portion is inflatable; when the side portion is deflated, the bottom support portion and the side portion may be bent to form an angle with respect to the seat back portion, the infant support thereby positionable upon a supporting surface, the bottom support portion and side portions depending downward, away from the supporting surface; the support further includes one or more fasteners for connecting the infant support to a supporting surface; the seat back portion and the side portion form mutually separate air chambers, each air chamber provided with a gas inflation valve; and the bottom support portion forming an air chamber separate from the seat back portion and the side portion, and having a gas inflation valve.

In further embodiments thereof, the seat back portion, bottom support portion, and side portion collectively form an interior, the interior provided with a fabric surface; the support further includes one or more inflatable arches releasably connectable to the infant support; the support further includes one or more inflatable toys releasably connectable to the one or more inflatable arches; the support further includes an infant safety restraint connected to the seat back portion and operable to limit movement of an infant within the child support; the support further includes a crotch restraint proximate the bottom support portion; and the support further includes one or more valves associated with the inflatable portions through which air can be admitted under pressure, or withdrawn under suction.

In another embodiment of the disclosure, an infant care kit, comprises a bag sized and dimensioned to contain—an infant support having—an inflatable seat back portion proximate a first longitudinal end of the infant support device and forming a back support and a portion of a bottom side of the infant support; a bottom support portion extending from the seat back portion in a direction of a second longitudinal end of the infant support device opposite the first longitudinal end, the bottom support portion forming a portion of a bottom side of the infant support; an inflatable side portion extending from the seat back portion along a first transverse side, then along the second longitudinal end, then along a second transverse side, the infant support forming an infant tub when the seat back and side portions are inflated, the infant support forming a chair when the seat back portion is inflated and the side portion is deflated, wherein the side portion is configured to be collapsible and bendable in a direction of the bottom support when the seat back portion is inflated; and one or more inflatable supporting arches; and one or more inflatable toys supportable by the one or more supporting arches.

In various embodiments thereof, the kit further includes a mat connectable to the one or more supporting arches; the mat is inflatable; the kit further includes an inflatable infant pillow; the bag includes a hook from which the bag may be suspended; the kit further includes an elongate inflatable safety bumper.

In a yet further embodiment of the disclosure, a method of supporting an infant, comprises inflating a seat back portion of an infant support device proximate a first longitudinal end of the infant support device thereby forming a back support and a portion of a bottom side of the infant support device; inflating a bottom support portion extending from the seat back portion in a direction of a second longitudinal end of the infant support device opposite the first longitudinal end, the bottom support portion forming a portion of a bottom side of the infant support device; inflating a side portion extending from the seat back portion along a first transverse side, then along the second longitudinal end, then along a second transverse side, the infant support thereby forming an infant tub; at least partially deflating each of the side portion and the bottom support portions; and bending the side portion and the bottom support portion to depend downwards from the seat back portion, thereby converting the infant tub to a chair.

In an embodiment thereof, the method further includes securing the infant support device to a supporting surface using one or more straps.

BRIEF DESCRIPTION OF THE DRAWINGS

A more complete understanding of the disclosure, and the attendant advantages and features thereof, will be more readily understood by reference to the following detailed description when considered in conjunction with the accompanying drawings, in which:

FIG. 3 depicts the infant support of FIG. 1, supported by and connected to a chair;

FIG. 4 depicts a safety restraint of the disclosure;

FIG. 5 depicts an inflatable safety bumper and media book of the disclosure;

FIG. 6 depicts the inflatable bumper of FIG. 5, having fasteners on only one side thereof;

FIG. 7 depicts the inflatable arches illustrated in FIG. 1, connected to a mat, together with inflatable toys suspended therefrom;

FIG. 8 depicts a manner of attaching the inflatable arches of FIG. 7 to the mat;

FIG. 8A depicts an enlarged view of a portion of the arch and mat of FIG. 8;

FIG. 9 depicts an alternative configuration of the inflatable arches of FIG. 7, and an inflatable pillow illustrated in FIG. 7 in use beneath an infant.

DETAILED DESCRIPTION OF THE INVENTION

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language).

Figure 1:
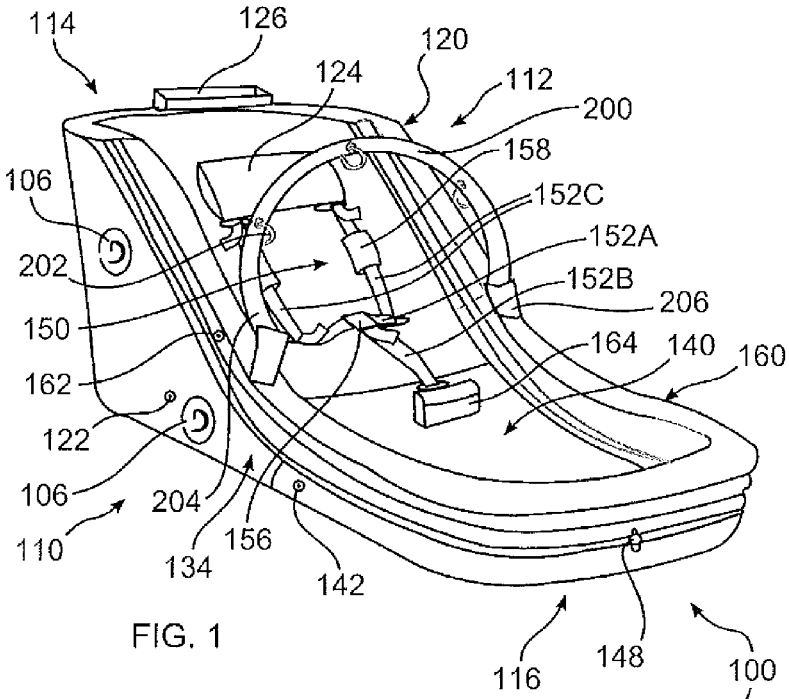
FIG. 1 depicts an infant support of the disclosure, partially inflated.
Figure 2:
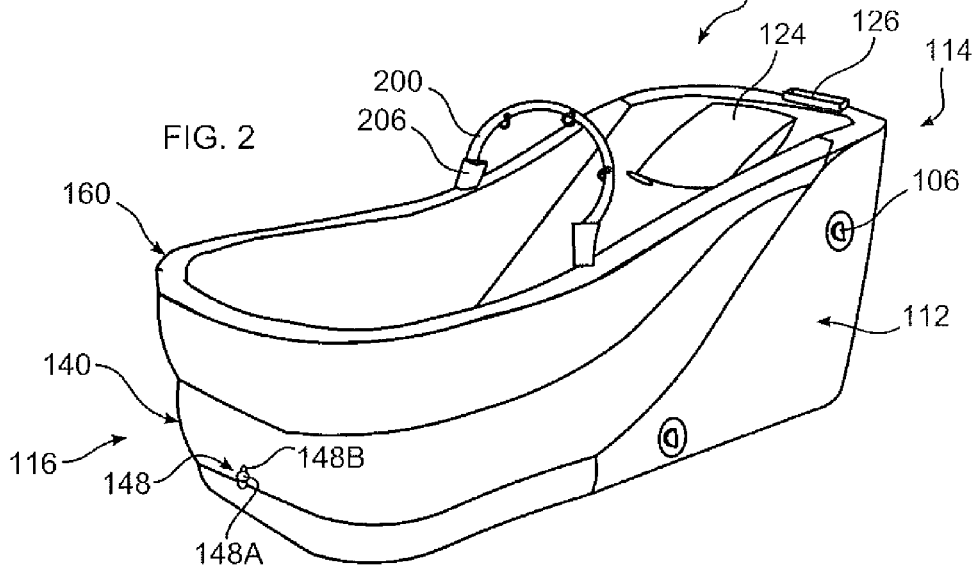
FIG. 2 depicts the infant support of FIG. 1, fully inflated.

With reference to FIGS. 1 and 2, a infant support device and seat system 100 of the disclosure includes a seat back portion 120, a bottom support portion 140, and an expandable side portion 160. In a chair or recliner configuration, shown in FIG. 1, expandable side portion 160 is deflated. In a infant support device configuration, shown in FIG. 2, expandable side portion 160 is inflated. System 100 is divided into at least two inflatable chambers, a chamber forming expandable side portion 160, and a chamber forming seat back and bottom support portions 120, 140. In another embodiment, there are three inflatable chambers, a first forming seat back portion 120, a second forming bottom support portion 140, and a third forming inflatable portion 160. Each may be resealably closed by fill valves 122, 142, and 162, respectively.

In an embodiment, expandable side portion 160 is pleated, whereby when deflated, the material forming expandable side portion 160 may be compressed and pushed flat, to render the desired chair or recliner shape. In FIG. 1, it may be seen that expandable side portion 160 begins at a point along a first transverse side 110 near a first longitudinal end 114 of system 100, continues around a second longitudinal end 116 opposite first longitudinal end 114, then extends along a second transverse side 112 opposite the first transverse side 110, to a point opposite the beginning point. A height of expandable side portion 160 varies from a short height near seat back portion 120, to a relatively taller portion near bottom support portion 140. In this manner, when system 100 is deflated and in the seat configuration, an infant or child seated within system 100 is laterally supported chiefly along the child's upper body. In this configuration, the child may easily play with people and objects extending outside of the confines formed by system 100. Similarly, access to the child for feeding and care is facilitated.

In one embodiment, bottom support portion 140 is inflatable, and in another embodiment, bottom support portion is not inflatable. Further, in an embodiment, bottom support portion 140 extends from first longitudinal end 114 to second longitudinal end 116, passing beneath back support portion 120. In another embodiment, bottom support portion 140 begins proximate an end of back support portion 120 and continues to second longitudinal end 116. In a yet further embodiment, illustrated in FIGS. 1-3, bottom portion 140 begins a distance from back support portion 120 and continues to second longitudinal end 116. In the latter embodiment, the infant's bottom remains supported by a lower portion 134 of back support portion after bottom support portion 140 is partially or completely deflated.

Thus, when system 100 is inflated, expandable side portion 160 is expanded to a greater extend near the legs of a seated child, and along the second longitudinal end, than near the shoulders of a seated child, near seat back portion 120. In the expanded infant support device configuration, system 100 will hold water within an interior of system 100 formed by seat back portion 120, bottom support portion 140, and expanded portion 160. It should be understood that when expanded portion 160 is completely filled with air and expanded, a basis is formed of sufficient depth to adequately cover a child so that the child may conveniently be bathed, for example to a waist or chest height of the child. However, expanded portion 160 may remain unexpanded, or partially expanded, and system 100 will still hold a quantity of water in the configuration shown in FIG. 2, whereby a child may safely play while seated in the shallow water thus contained. For example, system 100 may be placed outside, for example on a beach, or on grass, and a small amount of water may be placed within bottom portion 140, whereby the child may be cooled, or may play with the water, and possibly a waterproof toy, and be amused.

In an embodiment, a drain valve 148 is provided, for example within bottom portion 140, expandable portion 160, or any low water region of system 100. Drain valve 148 may include a water channel (not shown) to enable passage of drained water through an inflated section of bottom portion 140 or expandable portion 160, or material proximate drain valve 148 may be pinched together to form a narrow passage. Drain valve 148 can have the form of a cap or plug 148A, for example secured by a living hinge 148B, or can be a rotatable valve, or any other known means of controlling water flow from or into a bathing area formed by seat back portion 120, bottom portion 140, and expandable portion 160.

To reduce a likelihood of the child sliding out of a safe position, a safety restraint 150 can be provided, provided with one or more safety straps 152, which can include a lap belt 152A, a crotch strap 152B, and shoulder straps 152C, or other restraint strap configuration. One or more adjustment mechanisms 154 may be provided, as understood within the art, for adjusting a tension of the straps. Buckles, snaps, hooks, hook and loop fastener (e.g. VELCRO), or other connector 156 may be used to open one or more straps to facilitate placing the child within safety restraint 150. One or more strap pads 158 can be provided to insulate a seated child from chafing. In the embodiment of FIG. 2, safety restraint 150 is not illustrated, for clarity. In an embodiment, safety restraint 150 can be removed, for example using snaps, clips, or hook and loop fasteners (not shown). This can be useful, for example, when the infant is being bathed, and is otherwise being attended to.

To further secure a seated child in position, and with additional reference to FIG. 4, a crotch restraint 164 is attached or attachable to bottom portion 140. Crotch restraint 164 operates to prevent a child from sliding downwards, to a position lying on the child's back, which may be undesirable, particularly if there is water within system 100. One or more pillows 124 can be provided to support a portion of a child's body—the head in the example shown. A pouch or pocket 126 can be provided to contain child care items, for example food, toys, or shampoo. In various embodiments, crotch restraint 164, pillow 124, and or pocket 126 can be configured to be inflated when the inflatable portion from which they extend is inflated. In other embodiments, restraint 164, pillow 124, and or pocket 126 is separately inflated, or is attached or attachable to bottom portion 140, for example with an adhesive, or using a snap fastener, hook and loop fastener, clip, or buckle.

With reference to FIG. 3, it may be seen that expandable portion 160 and bottom support portion 140 are not inflated, or have been completely or partially deflated, and are thereby enabled to dangle or depend from chair 300. Seat back portion 120, which includes an inflated support behind and beneath a seated child, is positioned upon chair 300 or other structure, and is secured thereto using fasteners 106 and straps 108. A seated child can be secured within safety restraint 150, and is thereby prevented from falling from chair 300, for example while playing or eating. Arch 200 is depicted in FIG. 3, but can be removed if desired. In an embodiment, seat back portion 120 may be inflated completely or partially, affecting a height of seat bottom 128. In a further embodiment, an expansion pleat or additional inflation portion 130 can be provided, so that a wide range of seat heights are possible, to better align a seated child with a table top, for example, or to increase a tension of straps 108.

In the seated configuration of FIG. 3, it may further be seen that bottom support portion 140 protects the chair, or other structure upon which system 100 is mounted, from scuffing, staining, and other impacts. Further, the deflated or partially inflated expansion portion 160 forms a shelf upon which dropped or spilled materials may be collected, thereby preventing the materials from falling upon a floor surface.

To secure system 100 to an object, for example a chair, table, counter, or other item of furniture or structure, one or more securing fasteners 106 may be positioned about a surface of system 100. In an embodiment, a strap 108 extends from one side of system 100, and may be passed around the structure, to be clipped, tied, attached, or otherwise connected with system 100 on an opposite side thereof. In the example shown, fasteners 106 are D-rings, although any form of fastener, including snap, hook and loop, buckle, clip, or hook may be used, and may include a mechanism for adjusting a tension of the strap. In another embodiment, the strap is secured at both sides of system 100. In the configuration shown in FIGS. 1-2, an upper fastener 106 is positioned to be connected around a seat back, and a lower fastener 106 is positioned to be connected around a seat bottom.

An inflatable arch 200 extends across a portion of system 100, for example from transverse side 110 to transverse side 112, and can be used as an attachment point for toys or other objects to amuse a child seating within, or being bathed within, system 100. A series of clips, loops, or hooks 202 can be provided, or arch 200 can include hook and loop fastener portions or areas to which such objects may be releaseably fastened. Arch ends 204 can be configured to be inflated with another portion of system 100, or can be separately inflated. Arch 200 can further be attached or attachable to a remainder of system 100, for example at expanding portion 160, for example with an adhesive, or using a snap fastener, hook and loop fastener, clip, or buckle. As shown in further detail in FIG. 8, a receptacle 206 can be securely or permanently attached to system 100, and arch ends 204 can be snapped, cinched, or otherwise secured within receptacle 206 by a fastener 208.

In FIGS. 5-6, an inflatable toy and media bumper 400 is shown, having bumper fasteners 402. In the embodiment shown, fasteners 402 have the form of strings or hook and loop straps which may be tied to furniture, for example the interior of a crib, although other fastener types may be used. At least one fastener 402 is provided, and as illustrated, a plurality of fasteners may be provided upon a surface of media bumper 400, for example along a longitudinal or transverse side or edge of media bumper 400. Content 408, including for example indicia, or educational or playful images, or any other appropriate subject matter, may be visible upon a surface of media bumper 400. As shown in FIG. 5, a child may be placed along one side of media bumper 400, and be thereby protected from a potentially harmful impact with an object on another side of media bumper 400. While there positioned, the child may be amused or educated by content 408, which can include for example a reflecting surface; colors, particularly including black and white, which are best seen by young infants; textures; sounds, tones, or music; areas which may be pressed to produce sound or a changed image; various fabrics and materials; attached objects; or any other printed matter, objects, or materials which can entertain, educate, or develop an infant's senses or abilities. In an embodiment, media bumper 400 can be formed with hinges, where media bumper can be folded to reveal content 408 sequentially, as in a book. When media bumper 400 is deflated, it can be pressed flat to resemble a conventional book. A valve 404 is provided for inflating and deflating media bumper 400.

Turning now to FIGS. 7-9, it may be seen that two inflatable arches 200, inflated using a valve 224, are connected to a mat 210. In an embodiment, mat 210 is inflatable. In another embodiment, mat 210 is a foldable sheet, for example a flexible polymeric sheet. Positioned upon a surface of mat 210 are a plurality of receptacles 206, into which arch ends 204 may be inserted and fastened by a fastener 208, which can include a snap, hook and loop fastener, or other releasable fastener. In other embodiments, arch ends 204 may be releasably fastened to mat 210 by other fastener methods, for example snaps, or hook and loop fasteners. While a single arch may be used, FIGS. 7 and 9 illustrate two arches, which may be joined at an intersection 212 therebetween, which enables arches 200 to be mutually supported in an upright position. Fasteners as described herein, for example snaps or hook and loop fasteners, may be provided at one or more potential intersections along a length of each arch 200, enabling arches 200 to be erected to varying heights. For example, in FIG. 7, arches 200 form a maximum height, and in FIG. 9, a lower height forms a safe play area for a child.

As with other inflatable/deflatable items described herein, arches 200 can be deflated by opening valve 224 (not shown for all inflatable items) to release or admit air. When the valve is opened, arches 200 can be pressed to force out air, and then folded. Suction may also be used to further deflate inflatable/deflatable items, or to speed deflation. Pump 600 can be used for inflation, and in one embodiment, for deflation as well.

As may be seen in FIG. 7, inflatable toys 220 can be provided, and can have loops or other fastener means, with which toys 220 can be attached to dangle from arch 200, to amuse and educate a child at play. The toys may additionally be removed from the arch and used separately, for example the infant can play with them when the infant is upon mat 210, being bathed, or traveling in a vehicle.

As may additionally be seen in FIGS. 7 and 9, an inflatable infant pillow 222 can be provided to support an infant's head or neck, aid in learning to crawl, or support an infant during feeding, bathing, or when traveling in a vehicle, for example a car or plane. In the embodiment shown, pillow 222 is crescent shaped, although other shapes can be used, including rectangular, circular, or u-shaped, for example.

With reference to FIG. 8, receptacle 206 can attached to, or can extended from, material of mat 210 or any portion of system 100. In one embodiment, a snap, hook and loop, or other form of connector, can be disposed within or about the surface of arch ends 204 and receptacle 206. In the embodiment of FIG. 8A, receptacle 206A is formed within the inflatable structure, for example system 100 or mat 210, as an inward extension of the material of the structure, so that when the structure is inflated, receptacle 206A is formed. In this embodiment, arch end 204 may be pushed into receptacle 206A. If an interference fit is formed, there may be sufficient friction to adequately secure arch 200. In addition or in the alternative, a fastener may be incorporated within receptacle 206A, and a mating fastener portion may be formed upon arch end 204, as described with respect to FIG. 8.

Figure 10:
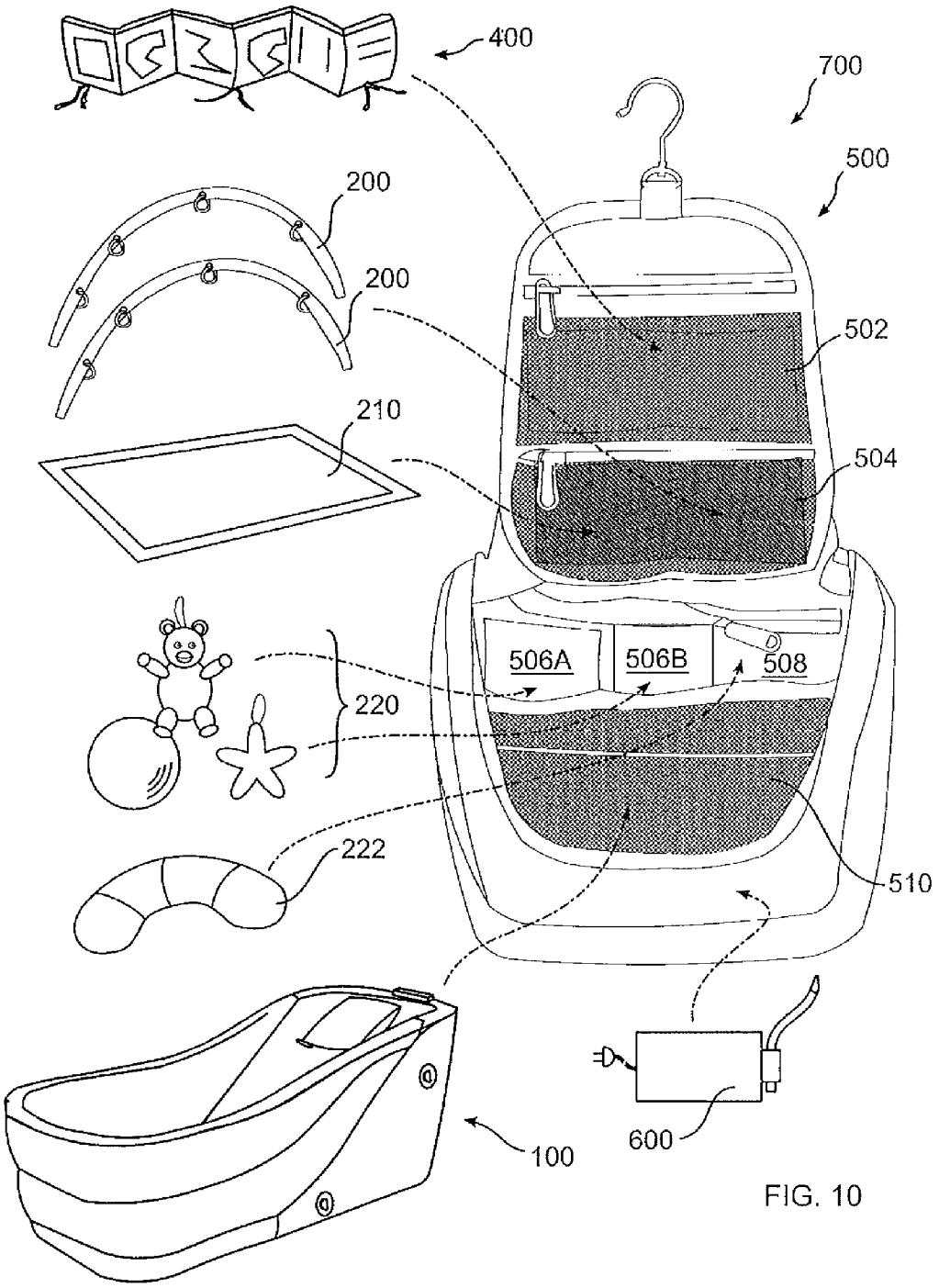
FIG. 10 depicts a travel bag of the disclosure, having compartments for containing the various inflatable elements of the disclosure.

Referring now to FIG. 10, a travel bag 500 unzips or otherwise opens to expose inner compartments 502-510 sized and dimensioned to hold deflated elements of the disclosure. In the embodiment shown, compartment 502 holds media bumper 400, compartment 504 holds mat 210 and arches 200, compartments 506A-B hold toys 220, compartment 508 holds pillow 222, and compartment 510 holds system 100, all of which can be deflated and folded to reduce their dimensions.

A hook can be provided, positionable within an interior or an exterior of bag 500, an operable to support travel bag in a vertical configuration, for example within a closet. Deflated elements which are still damp may be placed within their respective compartments, and may be caused to dry therein when bag 500 is suspended in relatively dry air. In an embodiment, one or more of compartments 502-508 have an outer mesh layer, configured to admit the passage of dry air into the compartment. In this manner, travel bag 500 forms a kit 700 of inflatable infant care elements of the disclosure, which is lightweight and easily transported.

Travel bag 500 can additionally be used to transport other useful items. For example, a battery operated or plug-in pump 600, which is advantageously of light weight and transportable, can be provided, used to inflate inflatable elements of the disclosure. It is further advantageous if pump 600 can produce vacuum or suction, in order to speed deflation of inflatable items, and to produce the smallest possible packed size for such elements. Alternatively, cans of compressed air may also be used to inflate inflatable items of the disclosure. Any non-toxic and preferably non-flammable gas may be used to inflate inflatable items, including for example air or nitrogen. Items may be inflated at high or low pressure, but it is advantageous for low pressure to be used, for the safety of the infant, at least, in the event of rapid decompression of the item, for example if melted or pierced.

Travel bag 500 can additionally include common infant care items, such as wipes, towels, diapers, pins, medicaments, lotions, feeding items, food, clothing, nail clippers, brush, comb, soap, shampoo, thermometer, spoon, teether, bandaids, or any other item which may be useful when traveling with an infant.

It should be understood that travel bag 500 or any other container can be used to form a kit 700 of the disclosure, which includes any or all of the inflatable/deflatable items described herein, including media bumper 400, mat 210, arches 200, toys 220, pillow 222, and system 100. Such inflatable/deflatable items of the disclosure can be connected to pump 600, which in an embodiment can form a suction to forcibly remove air from the inflatable/deflatable items, thereby causing the items to form the smallest possible dimensions in a relatively short time as compared with manually applying pressure to the items. A manually operated suction or inflation pump can also be used. Once deflated, the inflatable/deflatable items can be folded, rolled, bunched, or otherwise formed into a smaller dimension for insertion into kit 700.

In all embodiments herein, it is important that the fasteners used cannot come loose and be accidentally swallowed by a child. Further, the various embodiments of the disclosure should not contain materials which may be harmful if ingested, and should not include sharp edges or points, unless unavoidable.

Inflatable elements of the disclosure, which include media bumper 400, mat 210, arches 200, toys 220, pillow 222, system 100, and any other object disclosed herein as inflatable, or which is known to be inflatable, or which can be made to be inflatable, can be fabricated using any of the following materials in this exemplary and non-limiting list: a polymer, for example polyvinylchloride (PVC), synthetic rubber such as neoprene or polychloroprene, natural rubber, vinyl, latex, or nylon. Materials are advantageously selected to be non-toxic and hypoallergenic to infants. The inflatable material can be coated with a soft textured fabric or coating, which is comfortable to the infant. This material can be water resistant, or quick drying, so that clean-up is facilitated. Examples include natural or synthetic foams, felts, fabrics, for example a polyester material with a hydrophilic surface finish, flannel, or velour. In an embodiment, an interior portion of system 100, for example the interior in which the infant is seated or bathed, is provided with a removable fabric liner, which can be separately dried with respect to a remainder of system 100. For example, the liner could be placed in a washing machine and or a dryer, or may be left in sunlight to become dry.

Inflatable elements of the disclosure may be fabricated from the foregoing materials using any known method, or methods hereinafter to be discovered, and which methods can include ultrasonic welding, molding, extrusion, heat welding, and chemical welding, for example.

All references cited herein are expressly incorporated by reference in their entirety. There are many different features to the present invention and it is contemplated that these features may be used together or separately. Unless mention was made above to the contrary, it should be noted that all of the accompanying drawings are not to scale. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. An infant bathing tub, comprising:

an inflatable seat back portion proximate a first longitudinal end of the bathing tub, forming a back support;

a first inflatable bottom support portion forming a portion of a bottom side of the bathing tub, extending from the seat back portion in a direction towards a second longitudinal end of the bathing tub opposite the first longitudinal end;

a second inflatable bottom support portion forming a portion of the bottom side of the bathing tub extending from an end of the first bottom support portion to the second longitudinal end, the second inflatable bottom support portion independently inflatable with respect to the first inflatable bottom support portion; and inflatable side portions extending from the seat back portion along a first transverse side, then along the second longitudinal end, then along a second transverse side, the seat back, first and second bottom support portions, and inflatable side portions forming a water retaining tub shaped structure sized and dimensioned for bathing an infant when inflated;

the first and second bottom support portions bendable with respect to each other, and the inflatable side portions bendable when deflated, to change the tub shaped structure into a chair shaped structure.

2. The infant support of claim 1, wherein when the side portion and the second bottom support portion are deflated, the bottom support portion and the side portion may be bent to form an angle with respect to the seat back portion, the infant support thereby positionable upon a supporting surface, the bottom support portion and side portions depending downward, away from the supporting surface.

3. The infant support of claim 1, further including one or more fasteners for connecting the infant support to a supporting surface.

4. The infant support of claim 1, the seat back portion and the side portion forming mutually separate air chambers, each air chamber provided with a gas inflation valve.

5. The infant support of claim 4, the first and second bottom support portions each forming an air chamber separate from the seat back portion and the side portion, and each having a gas inflation valve.

6. The infant support of claim 1, the seat back portion, bottom support portion, and side portion collectively forming an interior, the interior provided with a soft textured fabric surface.

7. The infant support of claim 1, further including one or more inflatable arches releasably connectable to the infant support.

8. The infant support of claim 7, further including one or more inflatable toys releasably connectable to the one or more inflatable arches.

9. The infant support of claim 1, further including an infant safety restraint connected to the seat back portion and operable to limit movement of an infant within the child support.

10. The infant support of claim 1, further including a crotch restraint proximate the bottom support portion.

11. The infant support of claim 1, further including one or more valves associated with the inflatable portions through which air can be admitted under pressure, or withdrawn under suction.

12. The infant support of claim 1, further including at least one storage pocket connected to at least one of the seat back, support, and side portions.

13. An infant bathing tub, comprising:

an inflatable seat back portion proximate a first longitudinal end of the infant support device and forming a back support;

a bottom support portion extending from the seat back portion in a direction of a second longitudinal end of the infant support device opposite the first longitudinal end, the bottom support portion forming a bottom side of the bathing tub, the bottom support portion bendable along an axis transverse with respect to an axis extending between the first and second longitudinal ends;

an inflatable side portion extending from the seat back portion along a first transverse side, then along the second longitudinal end, then along a second transverse side, to be formable into a water retaining tub shaped structure, together with the bottom and the seat back when the seat back and side portions are inflated, the tub shaped structure sized and dimensioned for bathing an infant, and to be bendable when deflated to bend downwards with respect to the seat back, at the transverse axis of the bottom support, while the seat back is inflated, to be thereby formable into a chair when the seat back portion is inflated and the side portion is deflated.

14. The bathing tub of claim 13, further including one or more inflatable supporting arches.

15. The bathing tub of claim 13, further including at least one of a mat and an inflatable mat.

16. The bathing tub of claim 13, further including a portable pump operative to produce pressure to inflate inflatable objects.

17. The bathing tub of claim 13, further including a bag for containing bathing tub when deflated.

18. The bathing tub of claim 13, further including a storage bag, and at least one of an elongate inflatable safety bumper, a storage hook, and inflatable toys.

19. A method of supporting an infant, comprising:

inflating a seat back portion of an infant support device proximate a first longitudinal end of the infant support device thereby forming a back support and at least a portion of a bottom side of the infant support device;

inflating an expansion portion of a side portion of the infant support device, the expansion portion extending from an area proximate the seat back portion along a first transverse side, then along the second longitudinal end, then along a second transverse side, the seat back portion, bottom support portion, and expansion portion thereby forming a water retaining tub shaped structure sized and dimensioned for bathing an infant;

at least partially deflating the expansion portion of the side portion and the bottom support portions; and bending the expanding side portion and the bottom support portion to cause the expanding side portion and the bottom support portion to depend downwards relative to the seat back portion, thereby converting the tub shaped structure to a chair shaped structure.

20. The method of claim 19, further including securing the infant support device to a supporting surface using one or more straps.

21. The method of claim 19, further including draining the tub when the tub is retaining water by operating a valve.

* * * * *